United States Patent [19]

Macdonald

[11] Patent Number: 4,712,465

[45] Date of Patent: Dec. 15, 1987

[54] DUAL PURPOSE GUN BARREL FOR SPIN STABILIZED OR FIN STABILIZED PROJECTILES AND GUN LAUNCHED ROCKETS

[75] Inventor: Kenneth A. B. Macdonald, Maple Valley, Wash.

[73] Assignee: The Boeing Company, Seattle, Wash.

[21] Appl. No.: 901,486

[22] Filed: Aug. 28, 1986

[51] Int. Cl.[4] ..... F41F 17/06; F42B 13/28

[52] U.S. Cl. ..... 89/16; 42/78; 89/1.818; 102/372; 102/376; 102/379; 102/380; 102/432; 102/526; 102/374; 102/473

[58] Field of Search ..... 42/76.01, 78; 89/1.703, 89/1.704, 1.705, 1.818, 8, 14.05, 16; 102/372, 374, 376, 379, 380, 381, 431, 432, 437, 439, 443, 520, 521, 522, 523, 524, 526, 700

[56] References Cited

U.S. PATENT DOCUMENTS

| | | | |
|---|---|---|---|
| Re. 8,308 | 6/1878 | Reilly . | |
| 1,127,268 | 2/1915 | Malster . | |
| 1,355,422 | 10/1920 | Pederson . | |
| 2,549,832 | 4/1951 | Macta | 42/78 |
| 2,618,877 | 11/1952 | Macta | 42/1 |
| 2,635,021 | 4/1953 | Alward | 309/3 |
| 2,699,094 | 1/1955 | Musser | 89/1.7 |
| 2,700,839 | 2/1955 | Finlay et al. | 42/79 |
| 2,849,923 | 9/1958 | Cotterman | 89/16 |
| 3,229,583 | 1/1966 | Long et al. | 89/14 |
| 3,525,172 | 8/1970 | Marshall et al. | 42/78 |
| 3,602,086 | 8/1971 | Billingslea et al. | 89/7 |
| 3,814,019 | 6/1974 | Hines, Jr. | 102/91 |
| 4,527,348 | 7/1985 | Brennan | 42/78 |

FOREIGN PATENT DOCUMENTS 4198 of 1875 United Kingdom .

OTHER PUBLICATIONS

Townsend; Navy MK 4 Gun Pod Program, Fall 1968 (In Defense Management Journal, vol. III, ISS #4, pp. 26–27).

Bull; Project Harp, Mar.–Apr. 1968, (In Ordnance, vol. LII, No. 287, pp. 482–486).

*Primary Examiner*—Stephen C. Bentley

*Attorney, Agent, or Firm*—Thomas W. Hennen

[57] ABSTRACT

A gun barrel and projectile system utilizes a smooth central bore gun barrel fitted with a short rifled insert near the breech end. A projectile fitted with a perforated skirt and driving band about the base of the skirt are loaded into the gun barrel so that the driving band just engages the rifled insert, and the warhead portion of the projectile extends into the smooth bore portion of the barrel. Upon firing of a breech charge, gases from the breech charge are ducted to the space between the thin side walls of the projectile and the smooth central bore, thereby establishing a gas bearing. The gas bearing provides lateral support to the projectile and lubricates the projectile in the smooth central bore. Because of the lateral support the projectile receives from the gun barrel and the gas bearing, much less projectile structural strength is required to resist set-back forces. Mass fraction ratios of ordnance payload mass to structural mass in the projectile are on the order of ninety percent. Projectiles or guided rockets utilizing flip out fins or reaction jets during the ballistic trajectory portion of the flight are loaded in the gun barrel without a driving band so that no engagement with the rifled insert and consequently no projectile rotation occurs. Thus, a single gun barrel may be used to fire a large variety of projectile or rocket designs. Because the bore does not contain rifling at the muzzle, erosion at the muzzle is greatly reduced and barrel life increased many times. Additionally, muzzle velocity may be increased to achieve much greater range.

20 Claims, 5 Drawing Figures

DUAL PURPOSE GUN BARREL FOR SPIN STABILIZED OR FIN STABILIZED PROJECTILES AND GUN LAUNCHED ROCKETS

BACKGROUND OF THE INVENTION

1. Field of the Invention

This invention pertains to the fields of ordnance and ballistics. With greater particularity, this invention pertains to a gun barrel and projectiles or rocket assisted guided missiles for use therein. With greatest particularity, the present invention pertains to a gun barrel and projectile system wherein the performance advantages of a smooth bore barrel are achieved without compromising the ability to fire inexpensive spin stabilized rounds and while retaining the versatility to fire fin stabilized projectiles and gun launched rockets or guided missiles.

2. Description of the Related Art

Conventionally, gun barrels have been rifled by cutting a plurality of helical grooves defining lands therebetween in the bore. This is done for the purpose of engraving a projectile and causing it to rotate as it transits the barrel, thereby achieving spin stabilization of the projectile and increasing the accuracy and repeatability of its ballistic trajectory. One problem inherent in rifled barrels is that erosion of the rifling occurs at the muzzle, caused by the high velocity of the projectile and by muzzle efflux of hot propulsive gases, as the projectile exits the muzzle. This erosion rapidly reduces gun system projectile accuracy. A second problem with rifled barrels is that projectiles for use in rifled barrels must possess a sufficiently high level of structural strength, since little or no structural support is provided to the projectile by the barrel. This means that the set back forces in the projectile warhead, under very high acceleration, must be resisted by structure in the shell walls and the shell base.

As a consequence, only approximately ten percent of the projectile mass is high explosive or other warhead payload, the remaining ninety percent being inert structural mass. This same mass fraction limitation applies to gun launched rockets such as rocket assisted projectiles, where warhead mass fractions of only about ten percent are obtainable. For example, projectiles used in rifled gun barrels commonly will have a major diameter portion or bourrelet near the middle and perhaps a driving band at the rear which is in contact with the rifled bore surface. The frontal ogive portion and mid to rear portions of the projectile itself are often of smaller diameter than the gun barrel to avoid rifling wear as the shell expands under set-back pressure. This design requires the projectile to possess sufficient structural rigidity to resist deformation while undergoing the extreme acceleration environment of an artillery gun barrel during the firing sequence.

The muzzle velocity of rifled gun barrels is generally limited to between 3,000 to 4,000 feet per second. This is because rifling erosion which occurs at the muzzle is proportional to projectile muzzle velocity. Since, given equivalent ballistic coefficients, range is proportional to the square of the muzzle velocity, it can be seen that range is limited by muzzle velocity which in turn is limited by the amount of erosion which can be tolerated while still achieving the specified barrel life. Thus it may be seen that conventional rifled barrels firing conventional projectiles are limited in their performance by considerations of reasonable barrel life and the need to preserve accuracy of the ballistic trajectory, as well as structural requirements which greatly restrict the warhead payload capability.

These and other problems and limitations associated with the conventional rifled barrel and projectile have been overcome in the present invention which provides the accuracy advantages of a rifled barrel and spin stabilized or guided, rocket assisted projectiles without compromising the performance potential of a smooth bore barrel, in a versatile gun barrel and projectile system.

SUMMARY OF THE INVENTION

The present invention combines the structure of a rifled barrel with that of a smooth barrel to achieve the economic and performance advantages of each. The single gun barrel described herein below may optionally fire spin stabilized projectiles which engage a short rifled insert near the breech of the gun barrel to provide initial rotation to the projectile, or may alternatively fire fin stabilized projectiles or guided rockets which do not receive initial rotation in the gun barrel. Thus a single gun barrel may launch a wide variety of payloads of either the spin stabilized, fin stabilized or guided type.

The gun barrel includes a short rifled insert between the chamber and the smooth bore. A driving band, which is attached to and encircles the base of the spin stabilized projectile, engages the beginning of the rifling grooves and lands on the breech facing end of the short rifled insert. When the gun is fired, the projectile is accelerated towards the muzzle end of the barrel, and as it moves the driving band engravingly engaging the short rifled insert causes the projectile to rotate. A major portion of the projectile extends forward into the smooth bore barrel and is supported therein by high pressure breech gases which infiltrate the space between the smooth bore and the projectile side walls to form a lubricating gas bearing. As the projectile moves toward the muzzle, the driving band reaches the muzzle facing end of the short rifled insert. Just prior to the driving band entering the smooth bore, a tapered ring swages the driving band into a receiving groove on the projectile. The driving band is reduced in diameter and reshaped so that it will not interfere with the smooth bore barrel surface and so that it will not produce aerodynamic drag on the ballistic projectile.

Since the projectile driving band engages the rifling for only a short distance at the beginning of projectile travel, the driving band velocity as it leaves the rifling is relatively low and rifling erosion at this point is a fraction of that at the muzzle in a conventional rifled barrel. Subsequent projectile acceleration in the smooth bore barrel enables much greater muzzle velocity at exit than in a conventional rifled barrel since at the muzzle there are no rifling grooves to erode. Erosion of rifling in the rifled insert has no effect on accuracy since the smooth bore provides projectile guidance, and the rifled insert may be easily and inexpensively replaced when it wears out. Projectiles or guided missiles which are not intended for spin stabilization simply omit the driving band and thus pass by the short rifled insert and swaging ring without interaction. The breech charge is sized and designed for the greater acceleration obtainable in the present invention and the resulting increase in muzzle velocity translates into much greater range for the projectile than has heretofore been available.

Accordingly, one object of the present invention is to achieve a longer range artillery piece without compromising the ability to fire inexpensive spin stabilized projectiles. Yet another object of the present invention is to greatly extend barrel life while maintaining or increasing barrel performance. A still further object of the present invention is to provide a projectile which carries a much higher mass fraction of warhead active mass to structural mass, to thereby provide a more effective projectile. A still further object of the present invention is to provide an improved gun barrel and projectile system which operates in a nearly conventional manner yet is capable of firing a wide variety of projectiles. Additional objects and advantages of the present invention will be appreciated when reference is made to the detailed description which follows, taken in combination with the appended drawing figures.

BRIEF DESCRIPTION OF THE DRAWING

A better understanding of the structure and function of the present invention may be gained by referring to the appended drawing figures, wherein.

Finally.

DETAILED DESCRIPTION OF THE PREFERRED EMBODIMENT

Figure 1:
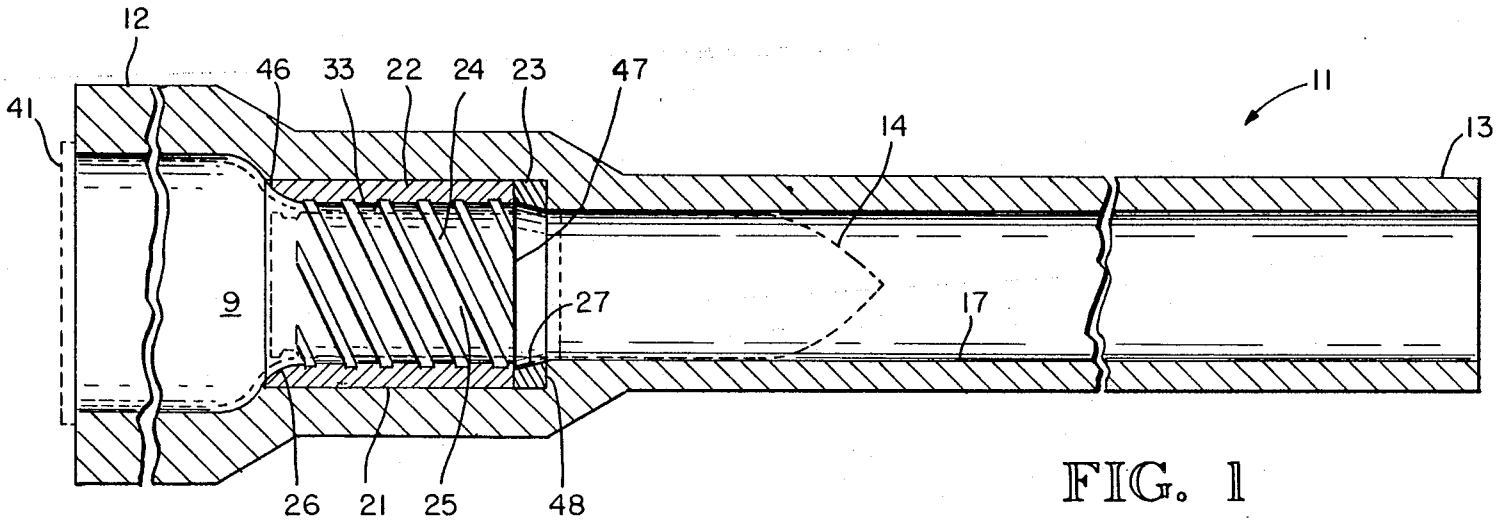
FIG. 1 illustrates a gun barrel system according to the present invention in sectional view.

Referring now to the drawing figures wherein like parts and elements are designated by like reference characters throughout the several views, and referring in particular to FIG. 1, there is shown a dual purpose gun 11 according to the present invention. Gun 11 has breech end 12 and muzzle end 13 in conformance to conventional ordnance terminology.

The barrel of gun 11 is shown in section and the position of projectile 14 and its associated cartridge case 41 are shown in phantom view for orientation purposes. The barrel of gun 11 has a smooth bore 17 over the major portion of its length. Abutting smooth bore 17 at a step transition is receiving bore 21 which communicates with chamber 9. Abutting the step transition between receiving bore 21 and smooth bore 17 is swaging ring 23. This ring is installed within receiving bore 21 and is oriented so that its internal conical taper 27 is oriented to taper from a larger inside diameter on the breech facing side of swaging ring 23 to a smaller diameter on the muzzle facing side of swaging ring 23.

Abutting swaging ring 23 is insert 22 which may be termed a sleeve and which is retained within receiving bore 21 by mechanical fastening means. For example, insert 22 may be in threaded engagement with the barrel of gun 11 in receiving bore 21 or it may be pressed in place and held by frictional forces resulting from an interference fit. The means of installing insert 22 within receiving bore 21 should be such that insert 22 may be easily replaced in the field when it becomes excessively worn.

Insert 22 has a plurality of helical grooves 24 machined or otherwise formed on its interior surface. These helical grooves 24 define lands 25 therebetween which will serve to engrave a projectile driving band and thereby cause a transiting projectile to rotate as its driving band moves past the grooves and lands. The breech facing end 46 of insert 22 is contoured at 26 to match the bottleneck transition or shoulder contour of chamber 9. This bottleneck contour provides support to the neck of a loaded cartridge case 41 while enabling the removal for repair or replacement of insert 22. Chamber 9 is designed to provide sufficient volume to contain the required amount of propellant 45 within a cartridge case 41 and the projectile skirt 62, needed to fire the projectile.

It may now be seen that the inside diameters for each face of taper 27 in swaging ring 23 are selected so that the breech facing side of swaging ring 23 is larger than the land diameter of insert 22. Similarly, the muzzle facing side of swaging ring 23 is selected to be the same diameter or slightly less than the diameter of smooth bore 17. This is so that the entire driving band will strike the tapered surface and be swaged to proper diameter for bore passage.

Figure 4:
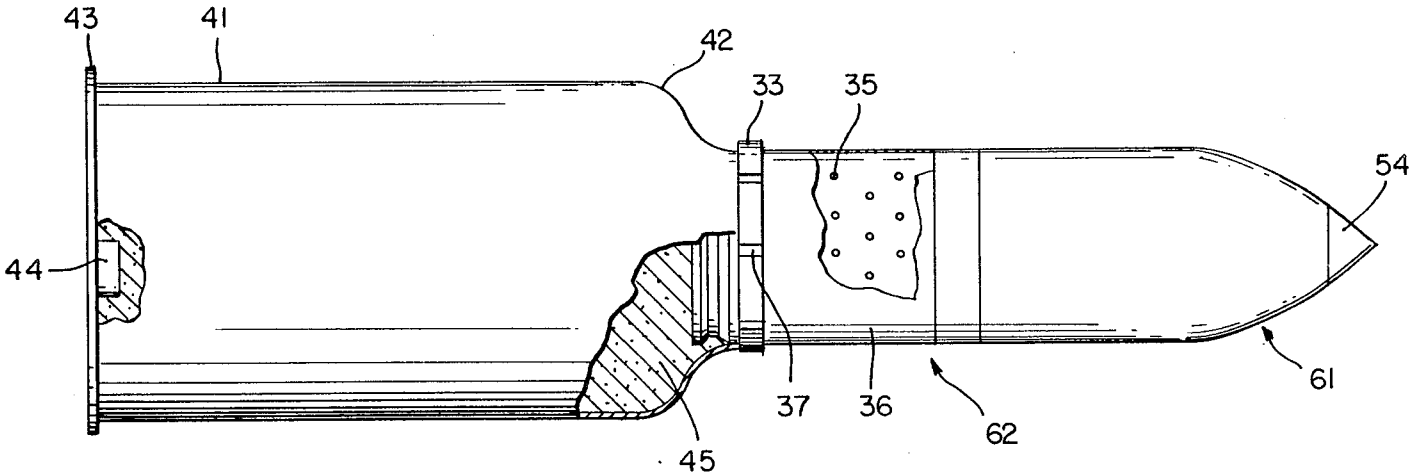
FIG. 4 illustrates a typical projectile round according to the present invention.

The details of interaction between swaging ring 23 and insert 22 will be better understood by referring to FIG. 4. There it may be seen that projectile 14 is encircled by driving band 33 which is placed forward of receiving groove 34. Driving band 33 is formed of a relatively soft material such as copper and is welded, such as by spin welding, or is otherwise rigidly affixed to projectile 14. As projectile 14 accelerates toward muzzle end 13 of gun 11, driving band 33 is engraved by lands 25 and slightly extrudes into grooves 24. As driving band 33 rotates projectile 14 and advances along insert 22, it eventually reaches swaging ring 23. The diameter of swaging ring 23 tapers down until it is equal to or slightly less than the diameter of smooth bore 17. Driving band 33 thus strikes the tapered surface of swaging ring 23, is reshaped in what might be termed a cold flow process, and is deposited within receiving groove 34 as receiving groove 34 passes swaging ring 23. This permits driving band 33 to pass through smooth bore 17 without interfering with the bore surface, and also eliminates aerodynamic drag which might be caused by extension of driving band 33 into the air stream during the ballistic trajectory phase of flight.

Figure 2:
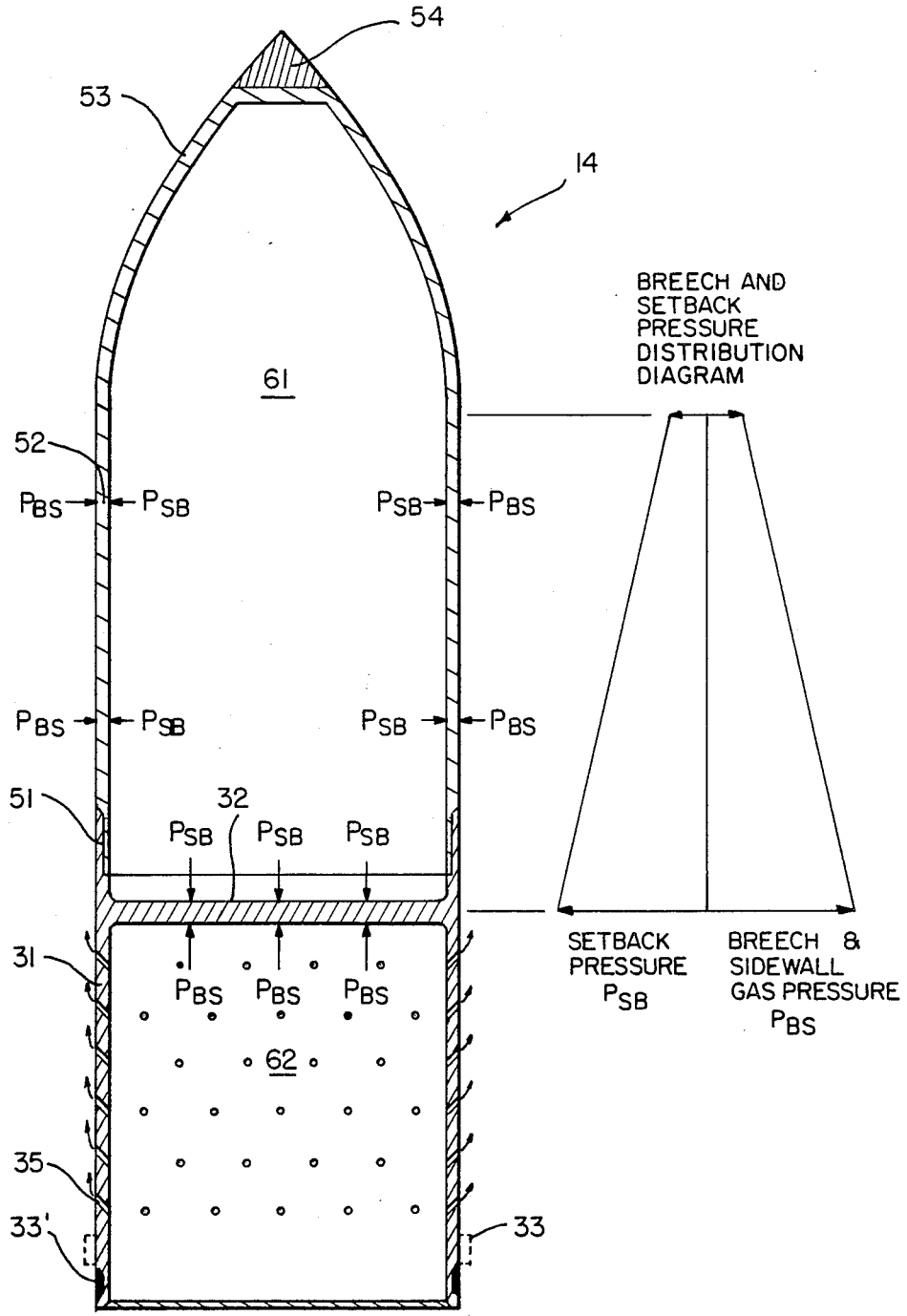
FIG. 2 illustrates a generic projectile according to the present invention in sectional view.

Of particular importance in the present invention is the manner in which the gun barrel and projectile structure directs breech gas pressure. As illustrated in FIG. 2, the structure of projectile 14 may be divided into a warhead section 61 and a skirt section 62. These sections are joined at threaded connection 51 which enables warhead section 61 to be loaded with high explosive or other ordnance payload.

Projectile 14 is formed from thin side wall 52 which may be steel or other commonly used engineering materials. As previously discussed, the requirement for projectile structural strength is greatly reduced in the present invention, and thus side wall 52 may be formed from thin plate or heavy sheet material. The forward portion of warhead section 61 is formed into ogive 53 which provides aerodynamic efficiency. Fuze 54 mounted at the apex of ogive 53 may be either a contact or proximity fuze depending upon mission requirements.

Skirt section 62 includes skirt 31 and skirt base bulkhead 32. FIG. 2, representing a projectile which has been fired but which has not yet exited the muzzle of gun barrel 11, is shown with driving band 33 in phantom view as originally positioned and as driving band 33' after being flowed into receiving groove 34 by swaging ring 23.

Referring now specifically to the manner in which the gun barrel and projectile structure directs breech gas pressure, particular note should be made of the plurality of pressure equalizing ports 35 arranged evenly over the surface of skirt section 62. When projectile 14 is loaded into a gun barrel and fired, high pressure resulting from ignition of propellant 45 in the breech chamber of the gun barrel and exerts pressure against skirt base bulkhead 32 and skirt 31. The high pressure gas flows through pressure equalizing ports 35, fracturing frangible film closure 36, and flows into the narrow clearance space 28 between projectile thin side wall 52 and smooth bore surface 17 around the periphery of projectile 14. Pressure entering clearance space 28 between thin side wall 52 and smooth bore surface 17 pressurizes this space proportional to the distance it is from skirt base bulkhead 32, as shown in FIG. 2. A pressure gradient in clearance space 28 extends from breech pressure near the base of skirt 31 to near atmospheric pressure forward of projectile 14 simultaneously with projectile movement.

As projectile 14 begins accelerating toward muzzle end 13, reaction or set back forces operating on the ordnance payload within warhead section 61 exert outward and backward pressure $P_{sb}$ against skirt base bulkhead 32 and thin side walls 52. This set back pressure is almost exactly balanced by pressure from propellant gases in chamber 9 which have flowed through pressure equalization ports 35 and now bear against smooth bore surface 17 and thin sidewall 52. This pressure balancing phenomenon is what enables projectile 14 to carry a mass fraction ratio of ordnance payload approaching ninety percent, leaving only ten percent mass fraction required for structural mass.

Breech gas pressure in clearance 28 additionally serves as a lubricant to prevent or minimize metal to metal contact between thin side wall 52 and smooth bore surface 17 which may otherwise occur. This reduction in friction combined with laminar flow in this region during projectile transit results in an additional propelling force, or as it may be termed, a negative friction, which increases muzzle velocity over the muzzle velocity of a similar rifled barrel.

Additionally, the flow of breech gas to clearance space 28 may be facilitated by forming a slot in driving band 33 as shown by slot 37 in FIG. 4. By placing several slots 37, which do not coincide with helical rifling grooves, about the periphery of driving band 33, gas pressure from propellant 45 may additionally flow past driving band 33 and into clearance space 28. Finally, grooves 24 may be cut to a depth in excess of that to which driving band 33 will extrude or move into grooves 24, leaving a gas flow area 38 for additional passage of breech gases. Hence, unlike conventional guns, the driving band does not seal pressure behind the projectiles.

Figure 3:
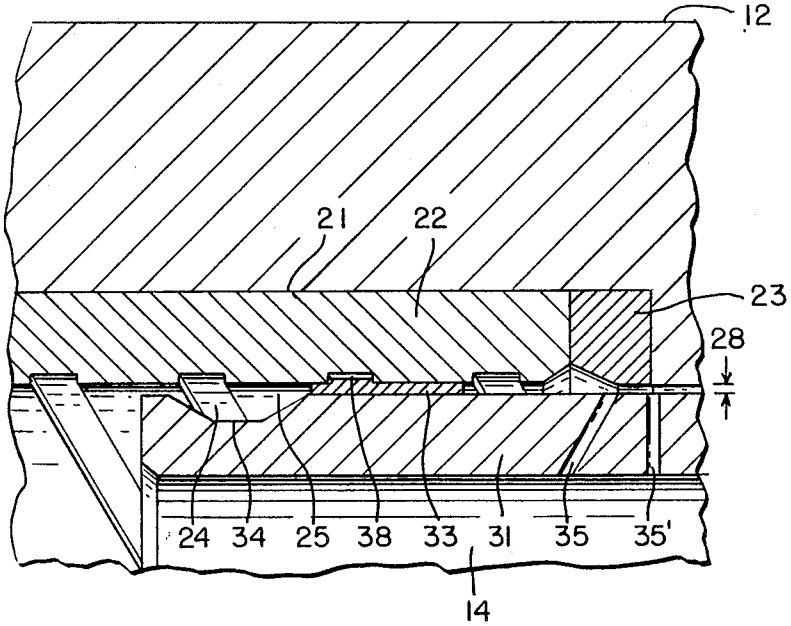
FIG. 3 illustrates, in sectional view, the mechanical details of the present invention which cause projectile rotation upon firing.

As clearly shown in FIGS. 2 and 3, pressure equalization ports 35 and 35' may be angled from inside skirt 31 to outside skirt 31 in the forward direction, they may be perpendicular to the longitudinal axis of projectile 14, or a combination of orientations may be used. Pressure equalization ports 35 should be dimensioned to have diameters within the range of from 0.010 to 0.250 inches or more so that they provide sufficient gas flow area yet do not contribute significantly to aerodynamic drag after projectile 14 has exited muzzle 13.

Clearance 28 should be small enough to restrict flow of breech gases sufficiently that energy is transmitted to the projectile rather than allowing the breech gases to simply blow by the sides of projectile 14. For example, a standard of the American Standards Association, ASA-B4.1 (1955) Class RC5 defines a standard sliding fit for a cylinder in a bore. This standard defines a close sliding fit which will provide proper operation in the present invention. The actual distance of clearance 28 will fall somewhere in the range between 0.002 inches and 0.050 inches, depending on projectile 14 diameter. Larger projectile diameters and consequently larger smooth bore diameters may tolerate a much larger clearance 28. Optimum clearance distances within the range may be easily arrived at through experimentation once a bore diameter has been selected.

The present invention is envisioned to be applicable to a wide variety of calibres, extending from small arms of the approximately .30 calibre dimension to what is traditionally termed field or naval artillery up to 18 inches in diameter. Of course, by making appropriate design changes to the propellant system to be utilized, particularly by the use of traveling charges, the present invention could be engineered to apply to smooth bore diameters in the range of ten to twenty feet for special purpose launching mechanisms with the capability to boost large payloads to reach earth orbit.

Insert 22 may be designed within fairly wide parameters, but in general would be expected to be from approximately 1.0 to 5.0 bore diameters between breech facing end 46 and muzzle facing end 47. Helical grooves 24 which provide the rifling to insert 22 may similarly encompass a wide range of pitches but in general would provide sufficient rotational energy to stablize the projectile over the length of insert 22. Much more severe pitch is possible in this insert than in a conventionally rifled barrel because the projectile is moving much more slowly at the beginning of motion while it is in insert 22 than it would be at the muzzle of a rifled barrel. The length of the barrel of gun 11 is independent of considerations related to the present invention, but would probably fall within the range of 30 to 150 bore diameters or calibres.

As is well known in the artillery art, the longer the barrel, the more difficult it is to control barrel droop resulting from increased barrel mass, and thus accuracy of the artillery piece is compromised. However, the longer the barrel, the longer the length of time the projectile is in the barrel, all other factors being equal and consequently the longer the length of time gas pressure may act on the base of the projectile to accelerate it to its ultimate muzzle velocity. Thus, traditional considerations must be taken into account in design of barrel length for the present invention the same as in any other conventional field artillery piece. As stated previously, the present invention lends itself to a wide variety of ordnance devices ranging from small arms and shoulder fired weapons to field artillery and artillery such as may be used on aircraft or ships.

Referring now to FIG. 4 the complete projectile round is illustrated partially broken away for clarity of illustration. Of particular interest in FIG. 4 is frangible film closure 36 which covers pressure equalization ports 35 during all phases of ammunition handling and shipment prior to actual use. Projectile 14 is shown inserted in the neck of cartridge case 41. The cartridge case and the shell skirt contain a predetermined amount of propellant 45 for pressurizing the base of projectile 14 when it is fired. Frangible film closure 36 thus serves to hermetically seal the gas propellant in the cartridge and shell shirt. Frangible film closure 36 may be an adhesively attached sheet which is easily fractured and penetrated by the force of hot gases emanating from propellant 45 when the projectile round is fired, but which is impervious to moisture and which resists abrasion and wear common in handling and storage of the projectile round prior to use. Frangible film closure 36 could be made from a composite metallic and polymer material or a thin metallic foil or other suitable material which is not affected by moisture. If pressure equalizing ports 35 are of sufficiently small diameter, frangible film closure could be a spray coating.

Cartridge case 41 is formed to match the bottleneck contour of the transition between chamber 9 and receiving bore 21 at shoulder 42. Cartridge case 41 may have a rim 43 or a band or other cartridge case design, depending upon the strength required and the type of gun barrel in which it is used. Means for igniting propellant 45 in response to a firing command is provided by primer 44 which may optionally be an electrically initiated primer or a percussion initiated primer, again depending upon the calibre and design of the gun barrel in which it is fired.

Figure 5:
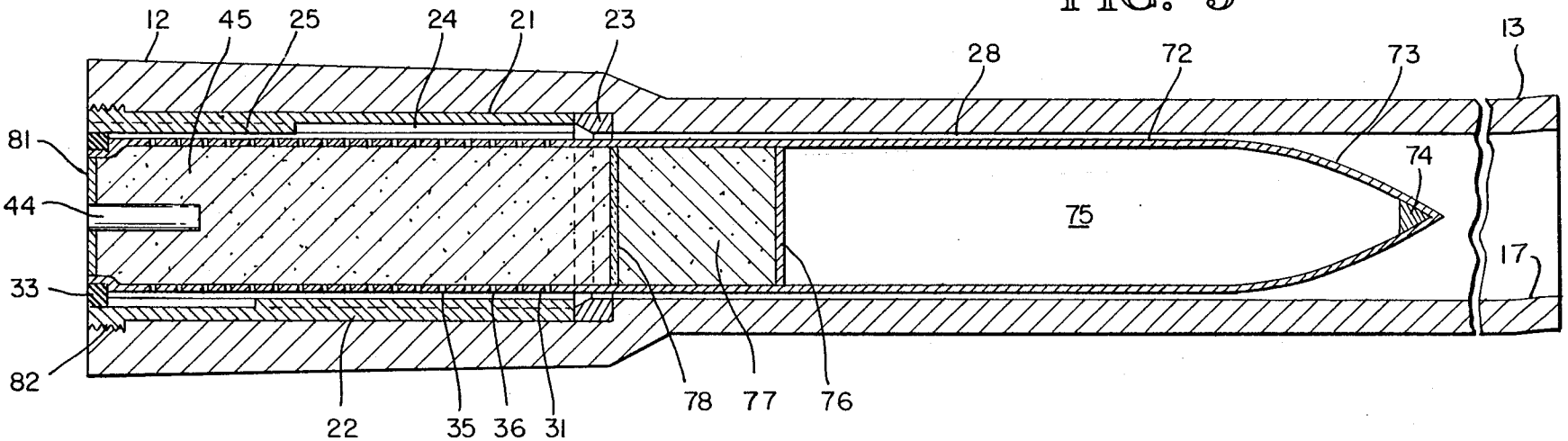
FIG. 5 illustrates an alternate embodiment of the invention which features a caseless round.

A further projectile and shell configuration for use in the present invention is illustrated in FIG. 5. This embodiment is better suited to smaller calibre gun systems where rapid fire and automatic loading are desirable, such as in airborne applications. In this embodiment, short rifled insert 22 occupies the full length of the chamber, and no bottlenecking of the chamber is necessary. Insert 22 is secured to the breech end 12 by means of threaded connection 82, although insert 22 could be pressed in place as previously described. This embodiment is a caseless round which does not require ejection of any residual hardware after firing.

The gun barrel design itself utilizes a swaging ring 23 and has breech end 12 and muzzle end 13 as previously described. The barrel has a smooth central bore 17 extending from the swaging ring 23 to the muzzle end 13. Insert 22 is longer than in previously described embodiments, extending perhaps up to five or more bore diameters in length, and correspondingly has a less severe helix angle on rifling defined by helical grooves 24 and lands 25.

The projectile illustrated in FIG. 5 for use in this embodiment includes high explosive warhead charge 75 contained within thin side wall 72 which forms a cylindrical body which tapers down on the front end at ogive contour 73 and includes fuze 74 at the forwardmost end. The aft end of high explosive warhead charge 75 is contained by warhead base bulkhead 76 which separate high explosive warhead charge 75 from traveling charge 77 as shown in FIG. 5. Traveling charge 77 is further separated from propellant 45 by consumable insulation layer 78, the material for which is selected to temporarily prevent ignition of traveling charge 77 until the projectile has traveled a predetermined distance down the gun barrel.

Materials which exhibit such controlled burn rates are well known in the ordnance arts. Consumable insulation layer 78 must exhibit resistance to combustion when propellant 45 is first ignited and yet must permit subsequent ignition of traveling charge 77 to provide additional mid barrel thrust to the projectile. Skirt wall 31 extends from thin side wall 72 to the base of the projectile which is closed by consumable base cover 81. Skirt wall 31 in combination with consumable base cover 81 and igniter 44 serves to contain propellant 45 and thus eliminates the need for a case which might otherwise be used to contain propellant 45.

Skirt wall 31 is penetrated by a plurality of small holes which enable breech gas pressure from ignition of propellant 45 to pass through the skirt and infiltrate the clearance space 28 between thin side wall 72 and smooth bore surface 17. A frangible film closure 36 is applied to the outer surface of skirt wall 31 to hermetically seal the propellant 45 against leakage through the numerous small holes in skirt wall 31 and to prevent water vapor from infiltrating skirt wall 31 and diminishing the effectiveness of propellant 45. The numerous small holes in skirt wall 31 are termed pressure equalization ports 35 as previously described in other embodiments of the present invention.

Consumable insulation layer 78 and consumable base cover 81 are made of conventional materials known in the art which provide sufficient mechanical strength to resist the rigors of manufacture and handling of projectile rounds while hermetically sealing out water vapor which might otherwise affect propellant 45. Upon firing of the projectile round, consumable insulation layer 78 and consumable base cover 81 are both completely consumed in a predictable manner in the combustion of propellant 45 and leave no residual debris which would impede loading of a subsequent round.

Driving band 33 is attached to the rear or aft end of skirt wall 31 and serves to interact with insert 22, which is rifled, to cause rotation of the projectile as it is fired. Swaging ring 23, as in other described embodiments, reshapes driving band 33 as it passes on its way into smooth bore 17.

In operation, this embodiment is loaded into a gun barrel of the present invention and fired. Upon activation of igniter 44, which may be a percussion igniter or an electric igniter as is well known in the art, propellant 45 immediately begins to burn, producing large quantities of gas. This gas pressurizes consumable insulation layer 78 and fractures frangible film closure 36 exiting skirt wall 31 through pressure equalizing ports 35 and pressurizes the volume between thin side wall 72 and smooth bore surface 17.

In this embodiment, driving band 33 need not be sloted since slotting would serve no purpose. Driving band 33 need not form a gas seal since base cover 81 is fully consumed when the round is fired and thus no pressure differential exists across driving band 33. Ignition of propellant 45 consumes base cover 81 and pressure acts against consumable insulation layer 78, traveling charge 77, and warhead base bulkhead 76 to begin accelerating the projectile towards muzzle end 13. At a predetermined point in its transit of the barrel, traveling charge 77 is ignited by high pressure, high temperature gases from propellant 45 which have caused combustion of consumable insulation layer 78. Traveling charge 77 provides additional gas pressure midway in barrel transit to continue the propulsive impulse acting against warhead base bulkhead 76 and tending to accelerate the projectile. As driving band 33 reaches swaging ring 23 it is reshaped to a smaller diameter which will fit within smooth bore 17 and continues with the projectile down the barrel.

Thus it can be seen that skirt wall 31 serves both as a cartridge case and as a portion of the projectile round itself which travels to the target, thus greatly facilitating loading and firing subsequent rounds. An additional advantage of the present embodiment of the invention, FIG. 5, is that breech end 12 of the gun barrel may be of smaller diameter than would be necessary were the chamber area bottlenecked as in previous embodiments. Skirt wall 31 is the same diameter as thin side wall 72. The projectile round having a single outside diameter from one end to the other will be easier to handle in automatic feeding mechanisms. The traveling charge will increase the muzzle velocity of the projectile, and the longer rifled insert need have less rifling helix angle so that the case is subjected to less torque during the initial rotational phase or spin out just subsequent to firing.

As the warhead leaves the muzzle 13 it will have a greater length to diameter ratio than in previous embodiments of the present invention which will reduce drag, and since it has a slightly greater mass, it will have a slightly increased range. Projectile rounds of this design should be cheaper and simpler to mass produce than is presently the case. Traveling charge 77 is positioned to be fully within smooth bore 17 when the projectile is loaded so that upon firing, it receives structural support from the gun barrel by means of the fluid layer surrounding it in clearance 28. This design may be referred to as a monolithic design since the functions of shell and cartridge case are now combined.

Of course in all designs of the present invention, a breech closure member which is not shown in the drawing Figures would be required at the base of the projectile to contain high pressure gas from propellant 45 as is conventionally known in the art.

Although projectile 14 has been illustrated as a generic projectile which could contain a wide variety of ordnance payloads, projectile 14 could additionally be a gun launched rocket which carries its own supply of propellant and continues to burn and supply thrust after exiting muzzle 13. An alternative projectile round may include a traveling charge which either burns continuously after the initial breech charge is fired or fires segments sequentially while the projectile is moving to the muzzle end of the gun barrel. A traveling charge of this type moves with the projectile and continues to supply high pressure gas in the region of the base of the projectile as it moves down the barrel, thus greatly increasing the projectile acceleration and velocity as it exits muzzle 13.

Generally speaking, the present invention using a barrel having a short rifled insert which is followed by a smooth bore for accelerating the projectile, and using a static breech charge should enable muzzle velocities in the range of 8,000 to 10,000 feet per second or more. This is roughly a doubling of muzzle velocity. Since range is proportional to the square of muzzle velocity as stated earlier, a quadrupling in range increase is made available by the present invention. Using a rocket assisted projectile with a traveling charge for example, muzzle velocities on the order of 20,000 feet per second should be obtainable.

Of course, ultimate muzzle velocity depends on projectile and propellant design and barrel length, among other considerations. However, the projectile velocity at the muzzle is no longer limited by the expansion rate of gas as it is when a static charge is fired in the breech, since the expansion rate of the propelling gas relative to the projectile remains approximately the same irrespective of muzzle velocity in a properly designed traveling charge round. With a breech fired charge the whole mass of the charge must be accelerated to half the velocity of the projectile whereas with a traveling charge only a small portion of the charge needs to be so accelerated. This increases gun efficiency from approximately thirty percent to approximately sixty percent because with a smooth bore gun much less energy is lost in the muzzle eflux. This also greatly decreases recoil forces, and barrel friction is negligible or even negative.

As explained above, $P_{bs}$ reduces linearly to the pressure ahead of the shell over the cylindrical portion of the case because of laminar flow in the small clearance 28 which exists between the thin side wall 52 and the smooth bore surface 17. It is noted that the set back pressure $P_{sb}$ also reduces linearly with distance from the shell base. However, internal and external pressures do not exactly balance because the high explosive or other ordnance payload filling the central cavity of warhead 61 in the ogive is not supported by the smooth bore wall and centrifugal stress set up by the spinning of the projectile is in addition to set back stress. These residual stresses are only about ten percent of the normal set back stress in a rifled gun so will not compromise the high mass fraction payload provided by the present invention.

Also worthy of note in the present invention is the fact that unlike a conventional driving band, driving band 33 does not provide a gas seal. The purpose of driving band 33 is solely to cause projectile 14 to rotate and not to provide a gas seal which would contain breech gas. A small pressure imbalance will exist at the shell base because of the work which must be done to spin the projectile, however, since this is only about 0.14% of propellant charge energy, it is not large compared to the amount of energy available in the breech charge.

Other projectile warhead designs could easily be incorporated in the present invention. For example a shrapnel warhead comprising a steel cylinder designed to fracture into fragments of the appropriate size could be included in warhead 61. Little shell case weight penalty is involved since the set back forces on the shrapnel cylinder are directly opposed across the shell base by the propelling pressure. Armor piercing darts could be stacked in warhead 61 so that their set back forces are again directly applied to the shell base on skirt base bulkhead 32.

A one stage rocket combined with a traveling charge in the present invention could give intercontinental range. Such a buried tube could fire one kiloton nuclear warheads at a one per minute per barrel rate provided that appropriate machinery were provided for loading gun barrel 11.

Of course the individual design of rocket assisted projectiles could involve a wide variety of design tradeoffs. A typical gun launched rocket would include a guidance section, a warhead and fuze on the front of the projectile surmounting a rocket motor and nozzle which fit within the gun bore. An insulating pad would be placed between the rocket motor solid propellant and a fast burning traveling charge carried within a self-consuming case attached to the base of the rocket nozzle. A traveling charge igniter and second insulating plug would separate the fast burning traveling charge from the static slow burning powder charge in the breech of the gun.

When such a rocket projectile is fired, the static charge would initially accelerate the rocket projectile and at a predetermined point in the barrel, an igniter would fire the traveling charge moving with the rocket projectile which would give it an additional impulse boost toward the muzzle end of the gun barrel. Upon exiting the muzzle of the gun barrel the insulating pad protecting the rocket solid fuel propellant would be blown away or consumed by hot gases, and a fast burning powder motor ignition charge fired within the rocket motor itself. The solid fuel rocket propellant grain would then ignite and additionally boost or maintain the velocity of the gun launched rocket.

Depending upon projectile design, fins presenting aerodynamic surfaces to the air flow may deploy early in the flight or perhaps could deploy during the terminal phase of the ballistic trajectory to guide the rocket to its target. All of these features are within the realm of projectile and warhead design and are in addition to the advantages provided by the present invention.

To recap the major advantages of the present invention, it should be noted that a single gun barrel tube can be used to fire spin stabilized projectiles utilizing a driving band to engage rifling in insert 22 or fin stabilized projectiles or guided missiles which omit the use of a driving band 33. Because of the structural support the smooth bore barrel and thin lubricating gas layer gives to the warhead or rocket motor, approximately ninety percent of projectile shell or rocket weight or mass may be high explosive or propellant, giving an order of magnitude of performance improvement over previous designs. Additionally, muzzle velocity can be at least doubled using the traveling charge and smooth bore concepts in combination and result in a quadrupling of effective range. These factors contribute an order of magnitude increase in warhead striking power and the quadrupling of range increase will revolutionize the impact of artillery barrage attack using so called dumb or unguided inexpensive rounds of ammunition. All of these advantages are obtained at the same time that gun barrel life is increased by at least a factor of ten since muzzle erosion, caused by breech gases flowing through rifling grooves as the projectile exits the muzzle, is eliminated in a smooth bore barrel.

The present invention lends itself ideally to a defensive ICBM deployment since the gun tube and projectile or missile are inherently hard and can resist the very high over pressures and ground shock which accompany a nuclear attack. Since the gun tube itself is hard, it can protrude in excess of forty feet from the ground to circumvent any debris problem which may accompany a nuclear attack. Some protection in this situation from transient nuclear explosive temperature effects on the gun barrel may be needed, but is thought to be well within the state of the art.

Since intercontinental range can be provided with a gun and missile on the order of 30 inches in diameter or less, the present invention also can be used for anti-ballistic missile defense, attack on submarines, or satellites, in addition to its intercontinental ballistic missile role. Missiles or projectiles for the present invention, because of their reduced size and need for structural strength, will be cheap and easily mass produced. Guided projectile systems and stellar guidance systems lend themselves to hardening against gun accelerations, and gyros suitable for guidance during climb out have already been developed for the gun environment. Thus, relatively sophisticated projectiles having their own guidance systems could significantly enhance the advantages of the present invention.

Having thus described the preferred embodiment of the present invention, it is to be understood that other modifications and variations will readily occur to those skilled in the art and it is to be understood that these deviations from the illustrated embodiment are to be considered as part of the invention as claimed.

I claim:

1. A gun barrel and projectile round combination, comprising:

an elongated tube having a smooth central bore and defining a muzzle end and a breech end;

a hollow cylindrical insert retained within said breech end coaxial with said smooth central bore and having a plurality of helical grooves defining lands therebetween on the inner surface of said insert;

a projectile loaded in said breech end, extending from the breech facing end of said insert forward into said smooth central bore, said projectile having a thin sidewall surrounding a central cavity and being dimensioned in diameter to provide a close sliding fit within said smooth central bore, said projectile further defining a hollow base circumscribed by a skirt which includes a plurality of pressure equalizing ports for transmitting breech pressure from the base of said projectile to the region between said thin sidewall and said smooth central bore; and a frangible film surrounding said projectile skirt closing said pressure equalizing ports.

2. A gun barrel and projectile round combination as set forth in claim 1, further comprising:

a driving band encircling and retained to said projectile skirt and engravingly engaging said helical grooves and lands at said breech facing end of said hollow cylindrical insert.

3. A gun barrel and projectile round combination as set forth in claim 2, further comprising a swaging ring having an internal conical taper positioned at the muzzle facing end of said hollow cylindrical insert adjacent said smooth central bore.

4. A gun barrel and projectile round combination as set forth in claim 1 wherein said hollow cylindrical insert is retained in threaded engagement with the breech end of said elongated tube.

5. A gun barrel and projectile round combination as set forth in claim 1 wherein said projectile further comprises a high explosive warhead contained within said central cavity.

6. A gun barrel and projectile round combination as set forth in claim 1 further comprising a cartridge case releasably attached to the skirt of said projectile, and propellant contained within said cartridge case and said skirt.

7. A gun barrel and projectile round combination as set forth in claim 1 wherein said hollow cylindrical insert is frictionally retained within said breech end.

8. A gun barrel and projectile round combination as set forth in claim 1 wherein said projectile and smooth central bore respective diameters are selected to achieve a projectile side wall to smooth central bore surface clearance distance of at least 0.002 inches.

9. A gun barrel and projectile round combination as set forth in claim 1 wherein said skirt includes a base bulkhead and said skirt joins said thin sidewall in a threaded connection.

10. A gun barrel and projectile round combination as set forth in claim 1, wherein said projectile further comprises a forward portion having an ogive contour.

11. A gun barrel and projectile round combination as set forth in claim 10, further comprising a fuze mounted on said projectile at the apex of said ogive contour.

12. A gun barrel and projectile round combination as set forth in claim 1 wherein said pressure equalizing ports are angled toward the muzzle end of said elongated tube from the inside of the skirt to the outside.

13. A gun barrel and projectile round combination as set forth in claim 2 wherein said driving band comprises copper.

14. A gun barrel and projectile round combination as set forth in claim 2 wherein said skirt further defines a circumferential receiving groove positioned adjacent said driving band at the breech facing end of said skirt.

15. A gun barrel and projectile round combination as set forth in claim 6 wherein said cartridge case further comprises an initiating primer for igniting said propellant in response to an external firing signal.

16. A gun barrel and projectile round combination which achieves increased projectile velocity and extends barrel life, comprising:

an elongated tube having a muzzle end, a breech end and a smooth central bore therebetween, said breech end further defining a receiving bore coaxial with said smooth central bore and having a diameter which is larger than the diameter of said smooth central bore, and meeting said smooth central bore at a step transition, said breech end further defining a chamber having a diameter which is larger than the diameter of said receiving bore and meeting said receiving bore at a contoured bottleneck transition;

a swaging ring having a conically tapered interior surface oriented to taper from a larger diameter on a breech facing side to a smaller diameter on a muzzle facing side, said swaging ring being retained within said receiving bore against said step transition;

a replaceable hollow cylindrical sleeve retained within said receiving bore abutting said swaging ring, said sleeve defining a plurality of helical grooves and lands, said sleeve being contoured on a breech facing end to match the chamber bottleneck transition;

a cylindrical projectile having a warhead section and a base section, said warhead section including a hollow cylindrical thin walled shell having an ogive contour on one end and being open on the other end, an ordnance payload contained within said thin walled shell, and a fuze for functioning the payload in response to the projectile encountering a target surface, said base section including a bulkhead and a cylindrical skirt depending therefrom forming a hollow base for said projectile, said base section being mechanically joined to said warhead section, said skirt defining a plurality of pressure equalizing ports distributed evenly about the periphery of said skirt;

a frangible film covering the exterior of said skirt, closing said plurality of pressure equalizing ports;

a slotted driving band encircling said cylindrical skirt at a point spaced from said breech facing end of said skirt and engaging said helical grooves and lands on the breech facing end of said sleeve;

the exterior surface of said skirt on said breech facing end defining a reception groove adjacent said slotted driving band;

a hollow case releasably attached to said skirt;

propellant contained within said hollow case; and means attached to said case for igniting said propellant in response to an external firing commend;

whereby upon reception of a firing command, the propellant is ignited and pressurizes the base of the projectile, high pressure gas from the propellant flowing through the pressure equalizing ports fracturing said frangible film and entering the space between the thin sidewall and the smooth central bore surface, said projectile being accelerated toward said muzzle end, said slotted driving band being engraved by said helical grooves and lands causing said projectile to rotate, said slotted driving band upon reaching said swaging ring being reshaped by said swaging ring and deposited into said reception groove just prior to entering the smooth central bore, said flowing high pressure gas forming a gas bearing between said projectile thin sidewall and said smooth central bore surface which balances setback forces operating on said projectile caused by acceleration and transmits lateral support to the thin sidewalls from the gun barrel to resist projectile deformation while also lubricating said projectile as it transits said gun barrel smooth central bore.

17. A gun barrel and projectile round combination as set forth in claim 16 wherein said sleeve is contoured on said breech facing end to join said chamber at said bottleneck transition.

18. A gun barrel and projectile round combination as set forth in claim 16 wherein said plurality of helical grooves have a depth which is greater than the engraving depth of the lands on the driving band, whereby high pressure gas from ignition of said propellant is enabled to flow past said driving band through said plurality of grooves.

19. A gun barrel and projectile round combination as set forth in claim 16 wherein said means for igniting said propellant comprises an electrically initiated primer.

20. A gun barrel and projectile round combination as set forth in claim 16 wherein said means for igniting said propellant comprises a percussion initiated primer.

* * * * *